US008369755B2

(12) United States Patent
Osaka et al.

(10) Patent No.: US 8,369,755 B2
(45) Date of Patent: Feb. 5, 2013

(54) DEVELOPING DEVICE AND IMAGE FORMING APPARATUS USING THE DEVELOPING DEVICE

(75) Inventors: Keiko Osaka, Mishima (JP); Yasuyuki Yamashita, Zama (JP); Ryoichi Kitajima, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 280 days.

(21) Appl. No.: 12/821,382

(22) Filed: Jun. 23, 2010

(65) Prior Publication Data

US 2010/0329748 A1 Dec. 30, 2010

(30) Foreign Application Priority Data

Jun. 25, 2009 (JP) ..... 2009-151360

(51) Int. Cl.
*G03G 15/00* (2006.01)

(52) U.S. Cl. ..... 399/286; 399/239; 399/279; 399/291; 399/295; 492/53; 430/123.3; 428/195.1

(58) Field of Classification Search ..... 399/239, 399/279, 285, 286, 291, 295; 430/123.3; 428/412

See application file for complete search history.

(56) References Cited

U.S. PATENT DOCUMENTS

| | | | | |
|---|---|---|---|---|
| 5,517,287 | A * | 5/1996 | Rodriguez et al. | 399/285 |
| 6,289,196 | B1 * | 9/2001 | Hsieh et al. | 399/266 |
| 2006/0135733 | A1 * | 6/2006 | Khouri et al. | 528/170 |
| 2008/0041721 | A1 * | 2/2008 | Hsiung et al. | 204/415 |
| 2009/0123193 | A1 * | 5/2009 | Kosugi et al. | 399/266 |
| 2010/0202801 | A1 * | 8/2010 | Otake et al. | 399/252 |

FOREIGN PATENT DOCUMENTS

| | | |
|---|---|---|
| JP | 3-21967 | 1/1991 |
| JP | 2004-198675 | 7/2004 |
| JP | 2007-133388 | 5/2007 |
| JP | 2008-76461 | 4/2008 |

* cited by examiner

*Primary Examiner* — David Gray
*Assistant Examiner* — Francis Gray
(74) *Attorney, Agent, or Firm* — Cooper & Dunham LLP

(57) ABSTRACT

The developing device includes a developer charging member configured to charge a toner serving as a one developer; and a developer bearing member configured to bear and feed the charged toner while forming an electric field so that the toner hops. The developer bearing member includes an insulating substrate; plural electrodes arranged on the insulating substrate in a developer feeding direction to form the electric field; and an outermost layer covering the plural electrodes. The toner has a softening point of from 115 to 130° C.

4 Claims, 5 Drawing Sheets

DEVELOPING DEVICE AND IMAGE FORMING APPARATUS USING THE DEVELOPING DEVICE

BACKGROUND OF THE INVENTION

1. Field of the Invention

The present invention relates to a developing device configured to develop an electrostatic latent image using a one-component developer (i.e., a toner). In addition, the present invention also relates to an image forming apparatus using the developing device.

2. Discussion of the Related Art

Methods for developing an electrostatic latent image are classified into two-component developing methods using a two-component developer including a magnetic carrier and a nonmagnetic toner, and one-component developing methods using a one-component developer including a toner and no carrier. Two-component developing methods have prevailed conventionally, but recently one-component developing methods are broadly used because of having advantages such that (1) it is not necessary to perform a carrier exchanging operation; (2) qualities of produced images can be maintained; and (3) a small and simple developing device can be used.

One-component developing methods use a one-component developer (hereinafter sometimes referred to as toner). The toner is frictionally charged with a developer layer thickness controlling member (hereinafter sometimes referred to as blade) and a developer bearing member (hereinafter sometimes referred to as developing roller) while a thin layer of the toner is formed on the developing roller. The toner on the developing roller is fed to a developing region in which the developing roller is opposed to an electrostatic latent image bearing member (such as photoreceptors) to develop an electrostatic latent image on the latent image bearing member, resulting in formation of a visual image (toner image) thereon.

The one-component developing methods include contact developing methods in which a developing roller is directly or indirectly contacted with an electrostatic latent image bearing member to develop an electrostatic latent image thereon. Specific examples of the indirect developing methods include jumping methods, methods utilizing an electric field curtain, and hopping development methods in which an alternate electric field is formed on the surface of a developer bearing member facing a photoreceptor so that toner particles hop, thereby forming a cloud of the toner, and an electrostatic latent image on the photoreceptor is developed with the toner cloud to form a toner image thereon.

For example, a published unexamined Japanese patent application No. (hereinafter referred to as JP-A) 03-021967 discloses a hopping development technique such that an alternate voltage is applied to plural electrodes arranged at predetermined intervals on an insulating substrate to form an electric field curtain on the surface of a roller-shaped developer bearing member, thereby supplying the toner to the surface of a photoreceptor.

Since one-component developing methods have advantages in fine line image reproducibility and image density evenness, the methods are preferably used for forming high quality images. Therefore, various proposals concerning the hopping development technique have been made, for example, by JP-As 2007-133388, 2008-070674 and 2004-198675.

In the hopping development methods, a developer bearing member having an electrode array including plural small electrodes to which an alternate voltage is sequentially applied is typically used for forming an electric field curtain so that charged toner particles hop toward an image bearing member. In this regard, it is preferable for the electrode array thus formed on the developer bearing member to form the desired electric field even after long repeated use without causing errors due to adhesion of toner to the array. Therefore, JP-A 03-021967 proposes a technique in that an outermost insulating layer is formed on an electrode array, wherein the outermost layer is constituted of an insulating material such as synthetic resins (e.g., polycarbonate resins, nylon resins, fluorine-containing resins, polyacetal resins, phenolic resins, and polyethylene resins) and rubbers. However, this outermost insulating layer serves as a substrate for supporting a number of electrodes in such a manner that the electrodes are located at proper positions in the outermost insulating layer, and no cover layer is formed on the electrodes. In addition, since nylon, polyacetal and polyethylene resins and rubbers are relatively soft, toner for low temperature and high speed fixation use tends to easily adhere to the electrode array. In addition, it is described in JP-A 2007-133388 that using fluorine-containing resins for an outermost layer seriously decreases the charge quantity of toner in a short time.

JP-A 2007-133388 discloses the following:

(1) The surface of a developer bearing member should have such a high volume resistance as to prevent leakage of charge of toner from the surface of the developer bearing member;

(2) Since toner causes friction with the surface of a developer bearing member, and thereby a protective layer protecting the surface of the developer bearing member is frictionally charged so as to have a charge having the same polarity as that of the charge of the toner while charging the toner so as to have a charge having the opposite polarity, resulting in gradual decreasing of the charge quantity of the toner, the surface of the developer bearing member should have such a volume resistance as not to cause the toner charge decreasing problem;

(3) When the surface of a developer bearing member has too high a volume resistance, the surface remains charged due to friction with the repeatedly hopping toner, resulting in variation of the surface potential of the developer bearing member, thereby making the development bias, which contributes to image development, unstable;

(4) For the reasons mentioned above, the surface of a developer bearing member preferably has a volume resistivity of from $10^9$ to $10^{12}$ Ω·cm, and it is preferable that the cover layer is made from a material selected from the group consisting of silicone resins, nylon resins, melamine resins, acrylic resins, polyvinyl alcohol resins, urethane resins, quaternary ammonium salts, and Nigrosine dyes; and (5) Two-component developers are relatively stable for high speed image formation compared to one-component developers.

It is not recommended in JP-A 2007-133388 to use a poly carbonate resin for the outermost layer.

JP-A 2008-076461 discloses techniques such that a layer having a thickness of from 0.5 μm to 2 μm and made of $SiO_2$, $BaTiO_2$, $TiO_2$, or the like is formed as a cover layer of an electrode array using a sputtering method; or a layer prepared by forming a polyimide layer with a thickness of from 2 μm to 5 μm using a coating method, followed by baking, is formed as a cover layer, wherein when such a polyimide layer causes a problem, a layer is preferably formed on the polyimide layer, which has a thickness of from 0.1 μm to 0.5 μm and which is made of an inorganic material such as $SiO_2$, by a sputtering method, and a layer may be formed on the inorganic material layer, which is made from an organic material such as polycarbonate resins, by a coating method. However, this protective layer manufacturing method is not simple because plural layers have to be formed by different methods.

On the other hand, heat fixing methods are typically used for fixing toner images formed by dry developing methods because of having good energy efficiency. Recently, the fixing temperature in heat fixing methods decreases more and more to save energy. Therefore, the present inventors recognized that in order to decrease the fixing temperature, it is necessary to use a low temperature fixable toner.

In contact one-component developing methods, toner is frictionally charged with a developer bearing member and developer a charging member (such as blades), while frictionally charged between a photoreceptor and a developer bearing member. Therefore, when such a low temperature fixable toner as mentioned above is used, a problem in that the toner is easily deteriorated by heat caused by the friction is caused.

Because of these reasons, the inventors recognized that there is a need for a one-component developing device, which can produce high quality toner images over a long period of time even when a low temperature fixable one-component developer (i.e., toner) is used.

SUMMARY

This patent specification describes a novel developing device. The developing device includes a developer charging member configured to charge a toner serving as a one-component developer, and a developer bearing member configured to bear and feed the charged toner while forming an electric field so that the toner hops. The developer bearing member includes an insulating substrate; plural electrodes arranged on the insulating substrate in the developer feeding direction to form the electric field; and an outermost layer (protective layer) covering the plural electrodes. The toner has a softening point of from 115° C. to 130° C., which is determined by the method described in JIS K7210 which is the same as ASTM E28-67.

This patent specification further describes a novel image forming apparatus. The image forming apparatus includes an electrostatic latent image bearing member configured to bear an electrostatic latent image thereon; and the above-mentioned developing device configured to develop the electrostatic latent image with a one-component developer to form a toner image on the electrostatic latent image bearing member.

BRIEF DESCRIPTION OF THE DRAWINGS

A more complete appreciation of the example aspects of the invention and many of the attendant advantage thereof will be readily obtained as the same better understood by reference to the following detailed description when considered in connection with the accompanying drawings, wherein.

DESCRIPTION OF THE PREFERRED EMBODIMENTS

AS mentioned below in detail, toner having a relatively low melting point (i.e., low temperature fixable toner), which cannot be used for conventional image forming apparatus using a one-component developing method because of being easily deteriorated, can be used for the image forming apparatus of the present invention.

The present invention will be explained by reference to drawings.

Figure 1:
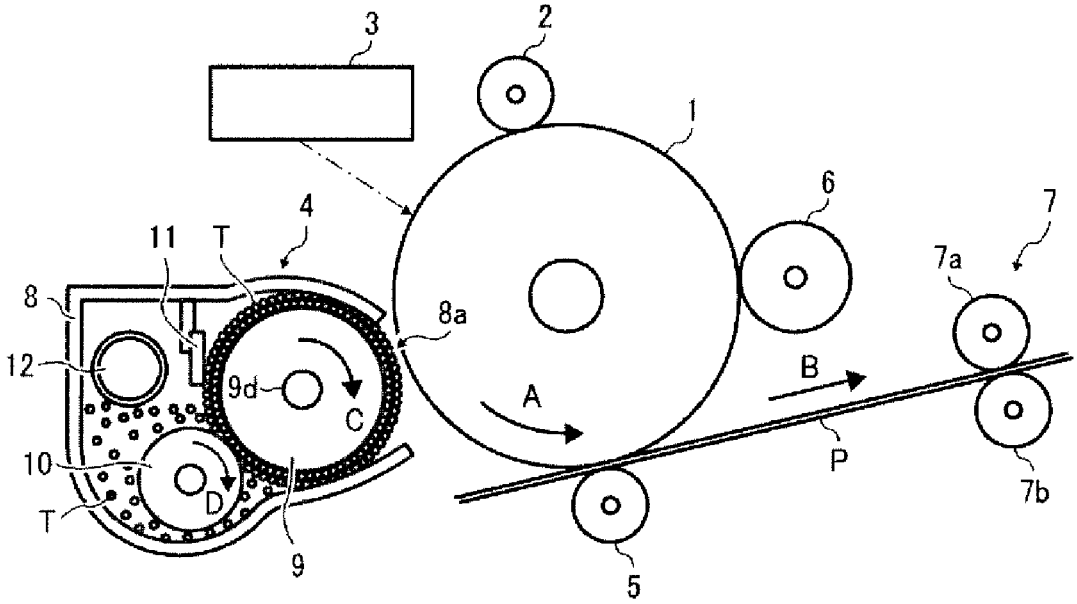
FIG. 1 is a schematic sectional view illustrating an image forming apparatus of an embodiment of the present invention, which includes an example of the developing device of the present invention.

FIG. 1 is a schematic sectional view illustrating an example of the image forming apparatus of the present invention.

Referring to FIG. 1, the image forming apparatus includes a drum-shaped photoreceptor 1 which serves as an electrostatic latent image bearing member and which rotates in a direction (A); a charging roller 2 serving as a charging device configured to evenly charge the surface of the photoreceptor 1; a light irradiating device 3 configured to irradiate the charged photoreceptor 1 with light (such as laser light) according to image information to form an electrostatic latent image on the photoreceptor 1; a developing device 4 configured to supply a toner to the surface of the photoreceptor 1 bearing the electrostatic latent image to form a toner image on the photoreceptor: a transfer roller 5 serving as a transfer device configured to transfer the toner image onto a receiving material P (such as paper sheets); a cleaning device 6 configured to remove residual toner particles from the surface of the photoreceptor 1 after transferring the toner image; and a fixing device 7 configured to fix the toner image on the receiving material P upon application of heat and pressure thereto.

The method for forming a toner image on the receiving material P in the image forming apparatus will be explained.

The charging roller 2 applies a predetermined voltage to the surface of the photoreceptor 1 rotating in the direction A to evenly charge the surface of the photoreceptor. The light irradiating device 3 irradiates the thus charged photoreceptor 1 with laser light according to information of an image to be visualized to form an electrostatic latent image on the photoreceptor. The developing device 4 supplies a toner to adhere the toner to the electrostatic latent image, resulting in formation of a toner image on the surface of the photoreceptor 1. The transfer roller 5 contacts the receiving material P with the surface of the photoreceptor 1 while feeding the receiving material in a direction (B) and applying a bias voltage to transfer the toner image onto the receiving material. The fixing device 7 heats and presses the receiving material P bearing the toner image thereon using a heat roller 7*a* and a pressure roller 7*b* to fix the toner image on the receiving material. Next, the cleaning device 6 removes residual toner particles from the surface of the photoreceptor 1 so that the surface of the photoreceptor is ready for the next charging operation. The image forming apparatus repeats the charging, light irradiating, developing, transferring, cleaning, and fixing operations to sequentially produce visual images.

In the image forming apparatus, the developing device, which visualizes an electrostatic latent image formed on a photoreceptor using a toner, is the feature of the present invention.

Next, the developing device of the present invention using a one-component developer (i.e., toner) will be explained.

As illustrated in FIG. 1, the developing device 4 includes a container 8 containing a toner (one-component developer) T;

and a developing roller 9 which serves as a developer bearing member and which is rotated in a direction C with a driving device to supply the toner T to the photoreceptor 1 through an opening 8*a* of the container 8. In addition, the developing device 4 includes a circulating paddle 10 configured to agitate and circulate the toner T to charge the toner while feeding the toner toward the surface of the developing roller 9.

The toner thus fed to the developing roller 9 is drawn thereby while born thereon by an electrostatic force. The thus drawn toner T is then scraped with a blade 11 serving as a toner regulation member (i.e., developer layer thickness controlling member) to form a toner layer having a predetermined thickness on the developing roller 9. As mentioned below, an alternate electric field is formed on a portion of the developing roller 9 located at the opening 8*a* to form a toner cloud. Toner particles in the toner cloud are electrostatically supplied to an electrostatic latent age on the surface of the photoreceptor 1, thereby forming a toner image on the surface of the photoreceptor. In FIG. 1, numeral 12 denotes a toner supplying opening through which a supplementary toner is supplied.

Examples of the electrode formed on the surface of the developing roller 9 are illustrated in FIGS. 2 and 5.

Figure 2B:
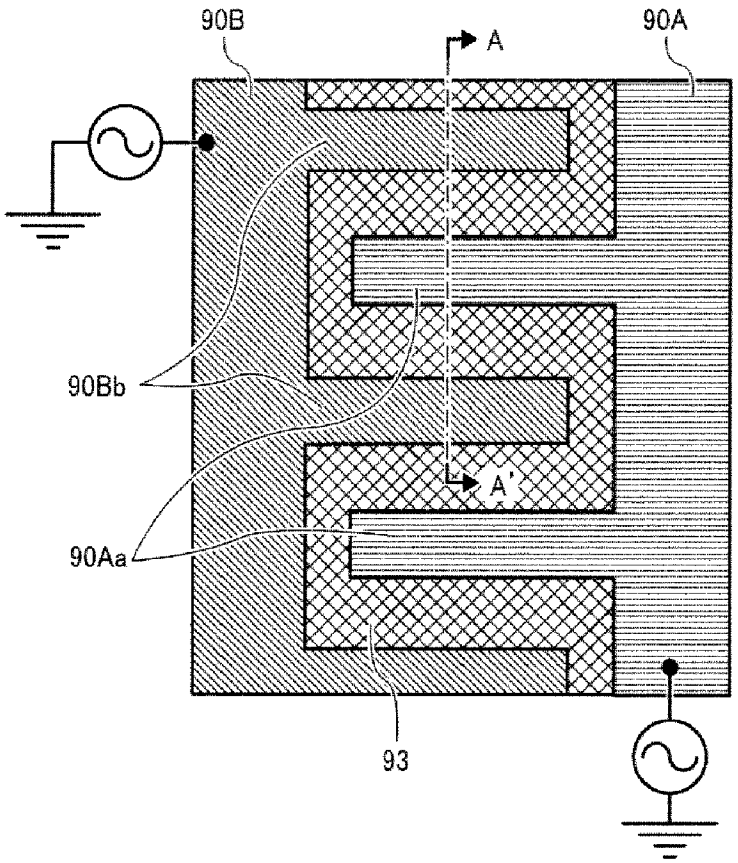
FIGS. 2A and 2B are schematic views illustrating a comb electrode for use in the developer bearing member of the developing device of the present invention.

At first, a comb-form electrode illustrated in FIGS. 2A and 2B will be explained. FIG. 2B is a plan view of a comb-form electrode, and FIG. 2A is a cross-sectional view of the comb electrode when the electrode is cut at a line A-A'.

Figure 2A:
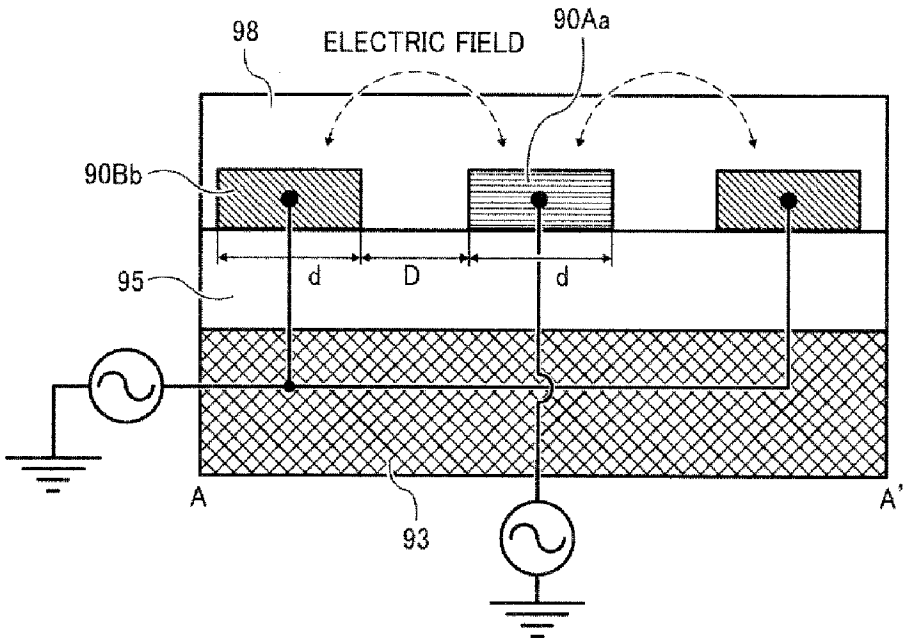

Referring to FIGS. 2A and 2B, the developing roller 9 includes a first patterned electrode 90A having plural linear electrodes 90Aa having a width d, and a second patterned electrode 90B having plural linear electrodes 90Bb having a width d, which are arranged so as to be parallel to the plural linear electrodes 90Aa with an interval D therebetween. In this regard, the linear electrodes 90Aa and 90Bb extend in a direction parallel to the axis of the developing roller 9.

Figure 3:
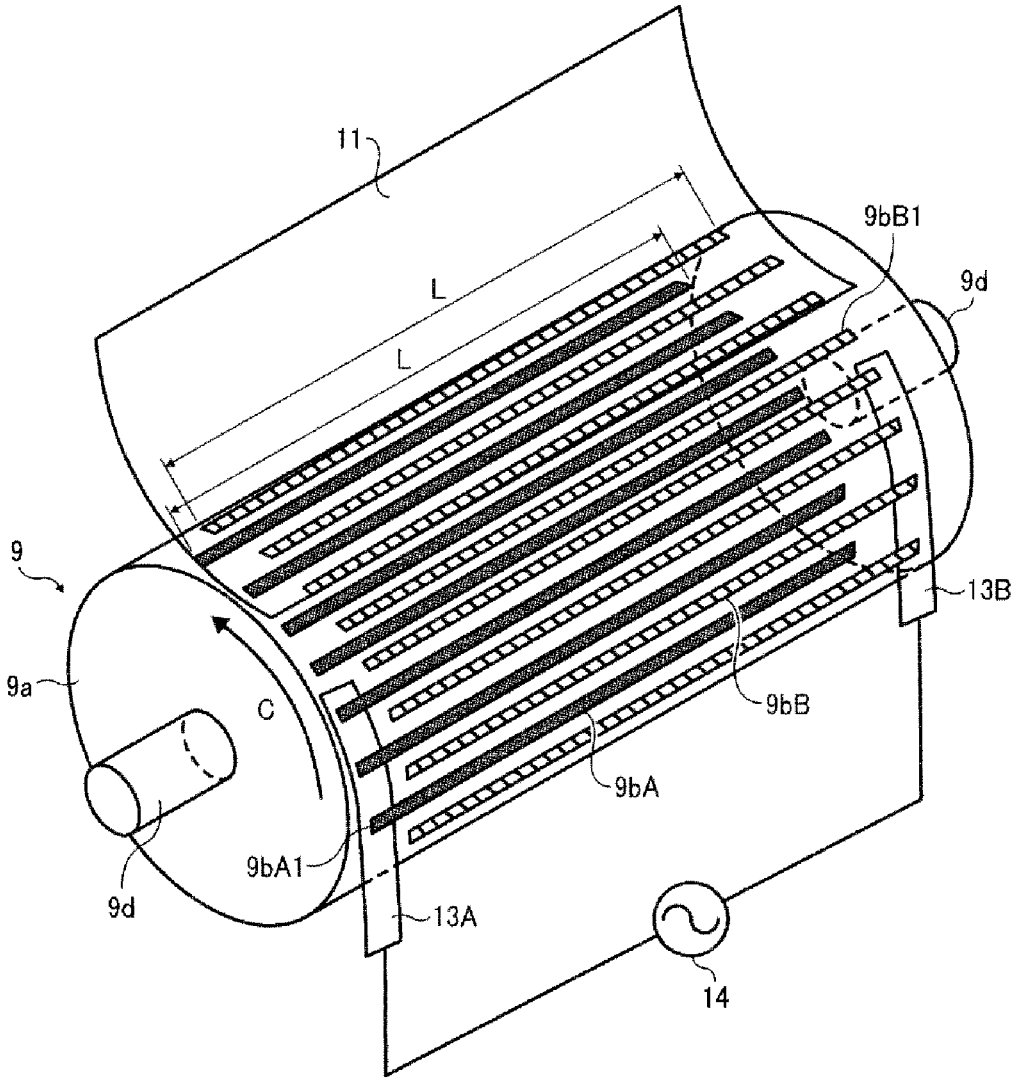
FIG. 3 is a perspective view illustrating a developing roller (developer bearing member) for use in the developing device of the present invention.

The electrodes 90Aa and 90Bb can be formed, for example, by forming a thin copper layer on the peripheral surface of a cylindrical substrate 93, which has a rotation axis 9*d* as illustrated in FIG. 3, by a vapor deposition method, followed by making the patterned electrode using a photo-resist method. The method for making the patterned electrode is not limited thereto, and a method using an inkjet device can also be used. In addition, the size of the substrate 93 is not particularly limited, and is determined depending on the developing device for which the developing roller is used. Further, the width d of each of the electrodes 90Aa and 90Bb, and the interval D between one of the electrodes 90Aa and the adjacent electrode 90Bb are not particularly limited, and are properly determined.

Specific examples of the cylindrical substrate 93 include insulating cylinders of a synthetic resin such as polyimide resins, polycarbonate resins, nylon resins, fluorine-containing resins, polyacetal resins, phenolic resins, and polystyrene resins; and metal cylinders, which are prepared by subjecting a metal such as aluminum, aluminum alloys, nickel, titanium, and stainless steel to a treatment such as cutting and polishing, followed by forming a cover layer of a resin (such as the synthetic resins mentioned above) on the metal cylinder.

In addition, as illustrated in FIG. 2A, an outermost layer 98 serving as a cover layer is formed on the patterned electrodes 90A and 90B to protect the electrodes 90Aa and 90Bb. In FIG. 2A, numeral 95 denotes an insulating layer.

Next, the upper and lower electrode type developing roller will be explained.

Figure 5B:
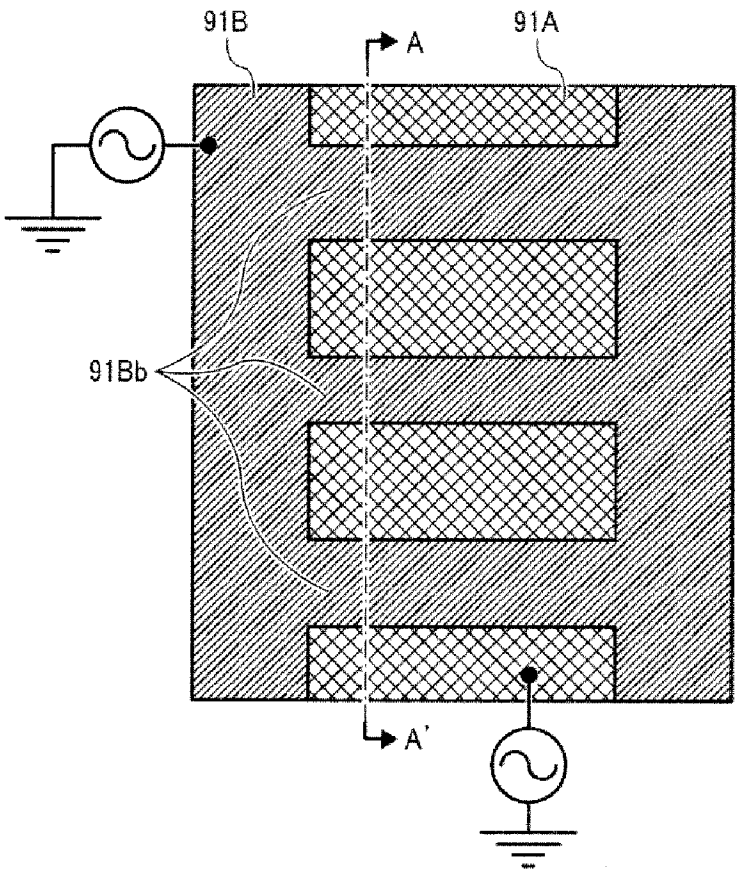
FIGS. 5A and 5B are schematic views illustrating an upper and lower electrode for use in the developer bearing member of the developing device of the present invention.
Figure 5A:
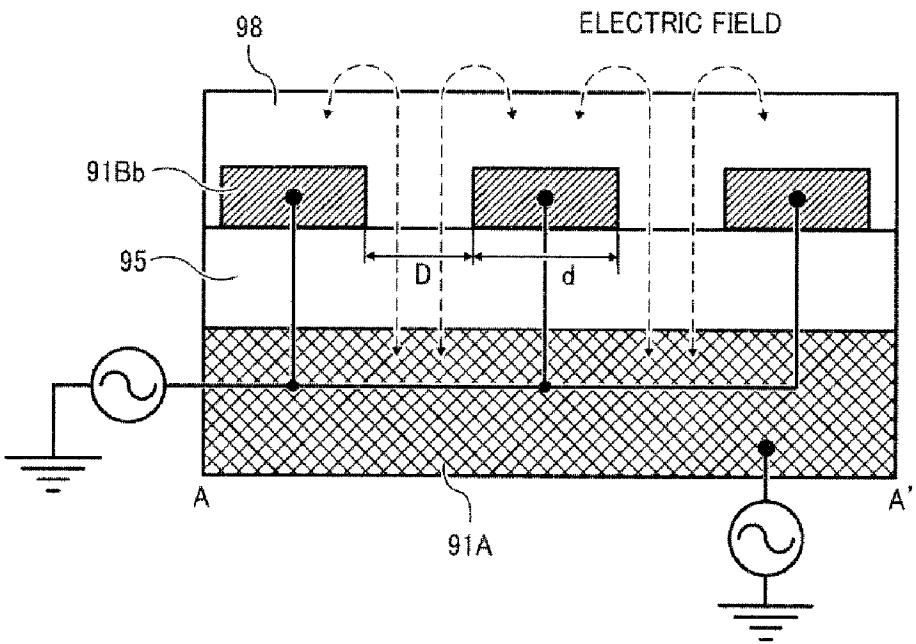

FIG. 5B is a plan view of an upper and lower type electrode, and FIG. 5A is a cross-sectional view of the upper and lower type electrode when the electrode is cut at the line A-A'.

Referring to FIGS. 5A and 5B, the developing roller 9 includes a substrate in which the insulating layer 95 is formed on an electroconductive substrate 91A. In this regard, the electroconductive substrate 91A (hereinafter referred to as a phase A) has the same function as the electrode 9Aa or 9Bb of the comb-form electrode. In addition, a patterned electrode 91B having plural linear electrodes 91Bb (hereinafter referred to as a phase B) is formed on the insulating layer 95. An electric potential difference is formed between the electroconductive substrate 91A (phase A) and the patterned electrode 91B (phase B) (i.e., electrodes 91Bb) so that toner particles hop, resulting in formation of a toner cloud. The electrode 91B is covered with the outermost layer 98.

Suitable materials for use in the electroconductive substrate 91A include materials having a high electroconductivity such as aluminum and aluminum alloys. In addition, substrates in which a resin substrate (such as polyimide resins, polycarbonate resins, nylon resins, fluorine-containing resins, polyacetal resins, phenolic resins, and polystyrene resins) is covered with a layer made of a highly electroconductive material such as aluminum and aluminum alloys can also be used as the electroconductive substrate 91A.

The size of the electroconductive substrate 91A is not particularly limited, and is determined depending on the developing device for which the developing roller is used. Further, the width d of the electrodes 91Bb, and the interval D between two adjacent electrodes of the electrodes 91Bb are not particularly limited, and are properly determined.

The present inventors have made various experiments to determine materials suitable for the outermost layer 98 of the developer bearing member (developing roller) so that toner cloud is stably formed on the outermost layer over a long period of time. As a result of the experiments, the present inventors discover that when polymers including a unit having the below-mentioned formula (1) are used for the outermost layer 98, a toner cloud can be stably formed thereon over a long period of time.

(1)

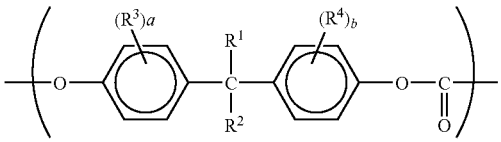

wherein each of $R^1$ and $R^2$ represents a hydrogen atom, an alkyl group, or an aryl group, wherein $R^1$ and $R^2$ optionally share bond connectivity to form a cyclic hydrocarbon group having 5 to 8 carbon atoms; each of $R^3$ and $R^4$ represents a hydrogen atom, a halogen atom, an alkyl group optionally having a substituent, or an aryl group optionally having a substituent; and each of a and b represents the number of the group $R^3$ or $R^4$ connected with a benzene ring, and is an integer of 1 or 2, wherein when a is 2, the two groups $R^3$ may be the same as or different from each other, and when b is 2, the two groups $R^4$ may be the same as or different from each other.

Specific examples of the units having formula (1) include the following, but are not limited thereto.

(M-1)
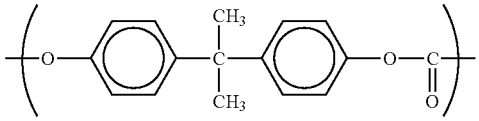
(M-2)
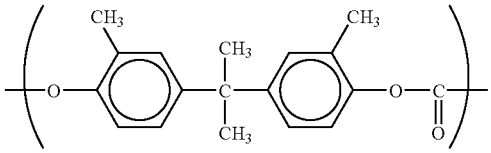
(M-3)
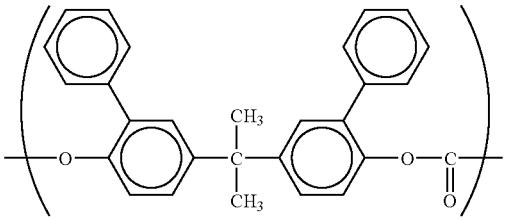
(M-4)
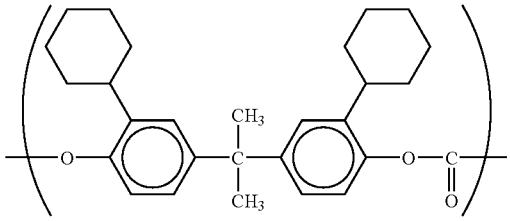
(M-5)
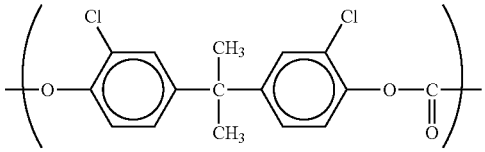
(M-6)
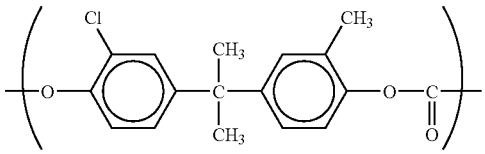
(M-7)
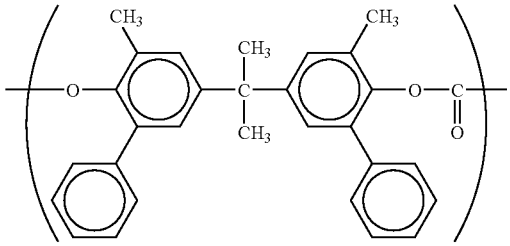
(M-8)
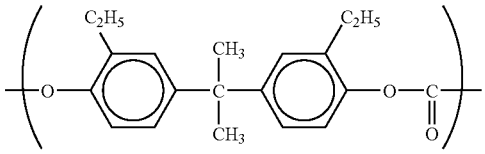
-continued
(M-9)
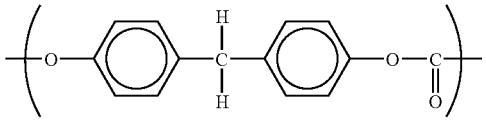
(M-10)
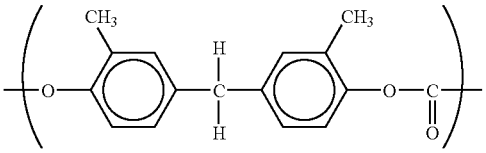
(M-11)
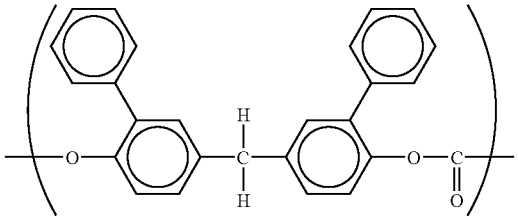
(M-12)
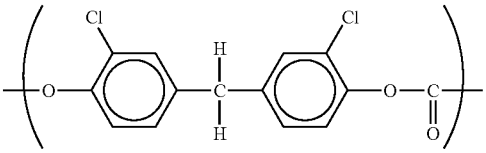
(M-13)
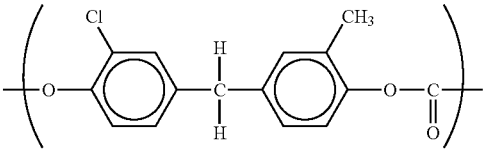
(M-14)
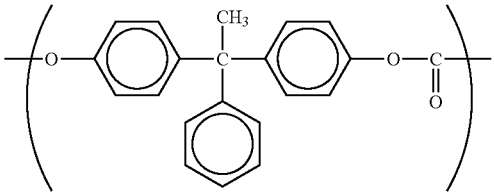
(M-15)
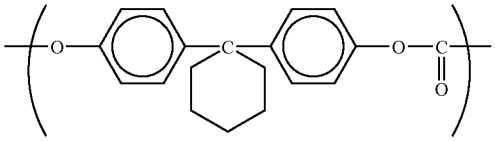
(M-16)
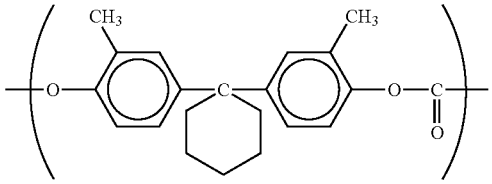

-continued (M-17)

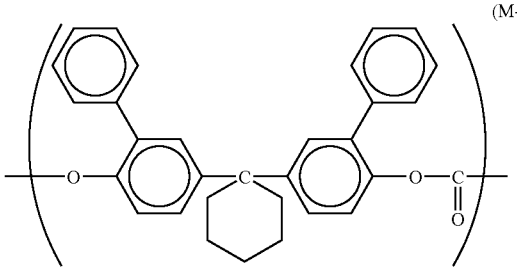

(M-18)

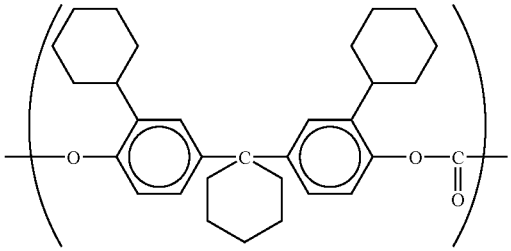

(M-19)

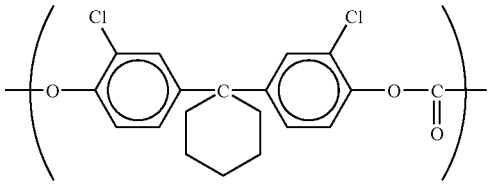

The outermost layer can include a leveling agent as an additive in addition to a polycarbonate resin.

Known materials for use as leveling agents can be used as the leveling agent.

Among these leveling agents, silicone oils can be preferably used because of imparting a smooth surface to the outermost layer even in a small added amount. Specific examples of such silicone oil leveling agents include dimethyl silicone oils, methylphenyl silicone oils, methylhydrodienepolysiloxane, cyclic dimethylpolysiloxane, alkyl-modified silicone oils, polyether-modified silicone oils, alcohol-modified silicone oils, fluorine-modified silicone oils, amino-modified silicone oils, mercapto-modified silicone oils, epoxy-modified silicone oils, carboxyl-modified silicone oils, higher fatty acid-modified silicone oils, silicone oils including a higher fatty acid, etc.

The outermost layer can further include proper amounts of additives such as plasticizers and antioxidants.

The outermost layer is typically prepared by a coating method in which a coating liquid prepared by dissolving a polycarbonate resin in one or more solvents such as tetrahydrofuran is applied using a coating method such as dip coating methods and spray coating methods.

The thickness of the outermost layer of the developer bearing member is not particularly limited. However, in order that leakage is not caused between an electrode of the developer bearing member and the outermost layer and the strength of the electric field formed on the developer bearing member is not excessively weakened, the thickness of the outermost layer is preferably from 3 μm to 20 μm. When the outermost layer has a thickness in this range, a problem in that the unstable toner cloud is formed due to decrease of the hopping electric field is hardly caused.

The insulating layer 95 is formed of one or more insulating materials. Specific examples of such insulating materials include synthetic resins such as polyester resins, polyimide resins, polycarbonate resins, nylon resins, fluorine-containing resins, polyacetal resins, phenolic resins, and polystyrene resins; water-soluble resins such as polyvinyl alcohol resins, casein, and poly(sodium acrylate); alcohol-soluble resins such as nylon copolymers, and methoxymethylated nylon resins; and crosslinkable resins such as polyurethane resins, melamine resins, alkyd resins, and epoxy resins. These resins can be used alone or in combination.

The thickness of the insulating layer of the developer bearing member is not particularly limited. However, the insulating layer preferably has a thickness so as not to cause leakage between the phase A and phase B when an upper and lower type electrode is used.

Figure 4:
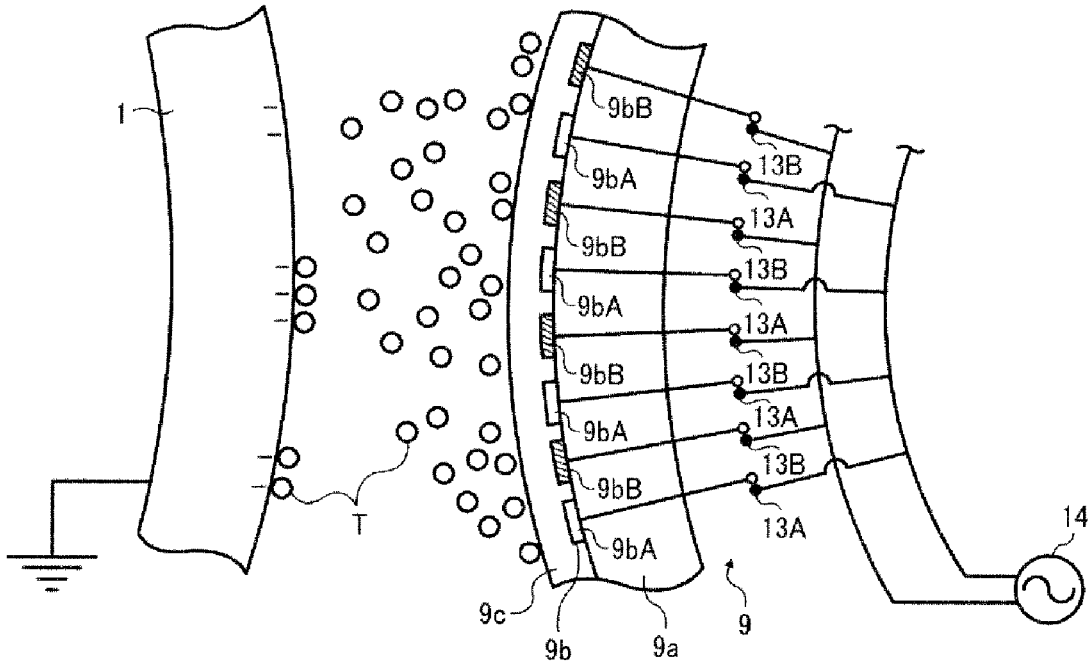
FIG. 4 is a schematic view illustrating the cloud state of toner formed on a developing roller of the developing device of the present invention.

In a comb-form electrode illustrated in FIG. 3, electrodes 9*b*A and 9*b*B (respectively corresponding to 90Aa and 90Bb illustrated in FIG. 2B) respectively have extending end portions 9*b*A1 and 9*b*B1, which can be electrically connected with terminals 13A and 13B provided on the side of the opening 8*a* of the container 8. In this regard, the terminals 13A and 13B respectively correspond to the electrodes 90A and 90B illustrated in FIG. 2B. An alternate voltage 14 is applied to each of the terminals 13A and 13*b*, and thereby the electric field formed between the plural electrodes 9*b*A and the plural electrodes 9*b*B of the patterned electrode 9*b* is changed. As a result, particles of the toner T born on the outermost layer 9*c* of the developing roller 9 hop between the surface of the photoreceptor 1 and the outermost layer 9*c* of the developing roller 9 due to the thus formed electric field as illustrated in FIG. 4, resulting in formation of a toner cloud therein. Toner particles in the toner cloud are attracted by an electrostatic latent image formed on the surface of the photoreceptor 1, resulting in formation of a toner image thereon.

The state of the thus formed toner cloud depends on variables such as width of the electrodes 9*b*A and 9*b*B of the patterned electrode 9*b*, the interval D between the electrodes 9*b*A and 9*b*B, and the applied alternate voltage. The size of the patterned electrode 9*b* is not particularly limited. However, in order to form a well-conditioned toner cloud on the surface of such a developing roller as illustrated in FIG. 3, the width d of the electrodes 9*b*A and 9*b*B, and the interval D between the electrodes 9*b*A and 9*b*B are preferably from 40 μm to 250 μm, and from 85 μm to 500 μm, respectively. In addition, the applied alternate voltage preferably has a frequency of from 100 Hz to 5 KHz, and a voltage of from 100V to 3KV.

In this example, the alternate voltage applied to the developing roller 9 is a single-phase alternate voltage. However, multi-phase alternate voltages having plural phases with different cycles can also be used. In this case, the patterned electrode 9*b* includes plural electrodes whose end portions have different lengths and which are adjacently arranged, wherein the end portions of the electrodes having the same-length end portions are connected with a terminal, and alternate voltages having different cycles are applied to the respective terminals. By using such multi-phase alternate voltages, toner cloud having a traveling wave form can be formed.

In this example, a rotating roller used as the developer bearing member. However, the developer bearing member is not limited thereto. For example, an insulating endless belt on which plural electrodes are formed at regular intervals while covered with an outermost layer can also be used. The endless belt is rotated at the opening 8*a* of the developing device 4 so as to serve as the developer bearing member. Alternatively, an arc member on which plural electrodes are formed at regular intervals while covered with an outermost layer and which is fixed at the opening 8*a* of the developing device 4 can also be used as the developer bearing member.

Next, the toner (i.e., one component developer) for use in the developing device of the present invention will be explained.

The toner includes a binder resin, a colorant, a release agent, and a charge controlling agent similarly to conventional toners.

Since the content of the binder resin in toner particles of the toner is relatively high, the thermal properties of the binder resin largely influence the viscoelasticity of the toner (toner particles).

The toner for use in the present invention has good low temperature fixability, and the binder resin included in the toner preferably has a softening point of from 115° C. to 130° C. In addition, the toner preferably has a softening point of from 115° C. to 130° C. In view of energy saving, the softening point of the binder resin included in the toner is preferably as low as possible. However, when the softening point is lower than 115° C., image density tends to decrease. In contrast, when the softening point is higher than 130° C., energy saving is hardly promoted although such toner can be used for the developing device using a flare developing method of the present invention and conventional one-component developing methods. In this regard, the term "flare" of the flare developing method means the movement of toner such that when an AC development bias is applied to the development region, the toner makes reciprocating movement between the electrodes due to the electric field formed by the electrodes. The flare developing method is one of hopping developing methods in which an electrostatic latent image on an image bearing member is developed with hopping toner particles In the present application, the softening point of a binder resin is measured by a method described in JIS K7210, which is the same as ASTM E28-67. Specifically the softening point is measured with an instrument, FLOW TESTER CFT-500 from Shimadzu Corp. The procedure is as follows.

(1) A sample (binder resin) is subjected to a sieving treatment to obtain particles of the resin present between a sieve of 9.2 mesh (having opening of 2.0 mm) to a sieve of 32 mesh (having opening of 0.5 mm);

(2) The particulate resin is molded so as to be a cylinder with a height of 10 mm;

(3) The cylindrical resin is heated at a temperature rising speed of 6° C./min. while pressed with a plunger at a pressure of $1.96\times10^7$ Pa so as to be extruded from a nozzle with a diameter of 1 mm and a length of 1 mm in order to obtain a softened resin flowing curve showing relationship between the temperature and the amount of descent of the plunger (i.e., amounts of resin flown out of the nozzle); and (4) The softening point of the resin is determined at the temperature at which the amount of descent of the plunger is 5 mm (i.e., in a S-form curve having a height of (h) and showing the relation between the temperature and the descent of the plunger, the temperature corresponding to the midpoint having a height of (h/2) (i.e., the temperature at which half of the cylindrical resin is flown out) is defined as the softening point.

The toner for use in the developing device of the present invention is prepared by a method such as pulverization methods and polymerization methods.

Pulverization methods typically include the following steps:

(1) Subjecting a toner constituent mixture including a binder resin, a colorant, a release agent, etc. to a melt kneading treatment;

(2) Cooling the kneaded mixture so that the kneaded toner constituent mixture solidifies;

(3) Pulverizing the solidified kneaded mixture;

(4) Classifying the pulverized material to prepare toner particles (mother toner particles); and (5) Optionally mixing the toner particles with an external additive using a mixer such as HENSCHEL MIXER to adhere the additive to the surface of the toner particles.

Polymerization methods include polymerizing one or more monomers in a solvent, and/or subjecting a prepolymer to a polymer chain growing reaction in a solvent.

Recently, pulverization toner which is a low temperature fixable toner and which includes a non-linear polyester resin and a linear polyester resin as binder resins has been developed. The present inventors discover that the low temperature fixability of such pulverization toner can be further improved by using a linear polyester resin having a softening point of about 100° C., and a molecular weight distribution property such that a molecular weight peak is observed in a range of from 5,000 to 8,000 while using a non-linear polyester resin having a higher acid value and a molecular weight distribution property such that a molecular weight peak is observed in a range of from 3,000 to 6,000.

Among polymerization toners, toner prepared by a polymer chain growing reaction method has a relatively good low temperature fixability. The present inventors discover that the low temperature fixability of such polymerization toner can be further improved by using an unmodified polyester resin (mentioned below) having a molecular weight distribution property such that a molecular weight peak is observed in a range of from 3,000 to 8,000 in combination with a wax having a relatively low melting point.

At first, the pulverization methods will be explained.

Any known resins can be used as binder resins. Specific examples of such resins include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyester resins, and combinations thereof are preferably used as the binder resin of the toner for use in the present invention.

Vinyl resins are homopolymers and copolymers of vinyl monomers. Specific examples of such vinyl resins include styrene-(meth)acrylate copolymers, styrene-butadiene copolymers, (meth)acrylic acid-(meth)acrylate copolymers, styrene-acrylonitrile copolymers, styrene-maleic anhydride copolymers, styrene-(meth)acrylic acid copolymers, etc.

Polyester resins are polymers obtained by subjecting a polyhydroxy compound and a polybasic acid to condensation polymerization.

Specific examples of the polyhydroxy compounds include glycols such as ethylene glycol, diethylene glycol, triethylene glycol, and propylene glycol; dihydroxy alicyclic compounds such as 1,4-bis(hydroxymethyl)cyclohexane; dihydroxy phenol compounds such as bisphenol A; etc.

In addition, compounds including three or more hydroxyl groups can also be used as the polyhydroxy compound.

Specific examples of the polybasic acids include dicarboxylic acids such as maleic acid, fumaric acid, phthalic acid, isophthalic acid, terephthalic acid, succinic acid, and malonic acid; and tri- or more-carboxylic acids such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexaenetricarboxylic acid, 1,3-dicarboxyl-2-methylenecarboxypropane, and 1,2,7,8-octanetetracarboxylic acid.

By using proper monomers, nonlinear polymers or linear polymers can be prepared.

The toner for use in the present invention includes a nonlinear polymer (1) and/or a linear polymer (2).

Nonlinear polymers (1) have good offset resistance, and linear polymers (2) have good low temperature fixability.

In the present application, the nonlinear polymers mean polymers substantially having a crosslinked structure, and the linear polymers mean polymers substantially having no crosslinked structure.

In order to prepare a polymer having a crosslinked structure, for example, a monomer having three or more reaction sites is used for preparing the polymer.

In addition, a hybrid resin (3) having at least the same polymer units as the polymers (1) and (2) can be used in combination with the nonlinear polymer (1) and/or the linear polymer (2). By using such a hybrid resin, the resins (1) and (2) can be well dissolved in each other, resulting in enhancement of the low temperature fixability of the toner. Such a hybrid resin (3) can be prepared by subjecting condensation polymerizable monomers and addition polymerizable monomer(s) to condensation polymerization and addition polymerization in parallel (i.e., at the same time) in the same reaction vessel. Alternatively, the condensation polymerization and addition polymerization may be performed independently (i.e., at different times) in the same reaction vessel.

Hybrid resins (3) are resins in which a condensation polymerization resin, which is prepared by a condensation polymerization method, such as the above-mentioned resins for use as the binder resin, and an addition polymerization resin, which is prepared by an addition polymerization method, are chemically bonded.

Vinyl resins prepared by a radical polymerization method are typically used as the addition polymerization resin, but the addition polymerization resin is not limited thereto.

Specific examples of the monomers for use in preparing addition polymerization resins include styrene, o-methylstyrene, m-methylstyrene, p-methylstyrene, α-methylstyrene, p-ethylstyrene, vinylnaphthalene, ethylene-type unsaturated monoolefins (such as ethylene, propylene, butylenes, and isobutylene), vinyl esters (such as vinyl chloride, vinyl bromide, vinyl acetate, and vinyl formate), ethylene-type monocarboxylic acids and esters thereof (such as acrylic acid, methyl acrylate, ethyl acrylate, n-propyl acrylate, isopropyl acrylate, t-butyl acrylate, amyl acrylate, methacrylic acid, methyl methacrylate, ethyl methacrylate, n-propyl methacrylate, isopropyl methacrylate, t-butyl methacrylate, amyl methacrylate, stearyl methacrylate, methoxyethyl methacrylate, glycidyl methacrylate, phenyl methacrylate, dimethylaminoethyl methacrylate, and diethylaminoethyl methacrylate), substituted ethylene-type monocarboxylic acids (such as acrylonitrile, methacrylonitrile and acrylamide), substituted or unsubstituted ethylene-type dicarboxylic acids (such as dimethyl maleate, vinyl ketone compounds (such as vinyl methyl ketone), etc.

A crosslinking agent can be used when preparing the toner.

Specific examples of the crosslinking agent for use in crosslinking an addition polymerizable monomer include known crosslinking agents such as divinylbenzene, divinylnaphthalene, polyethylene glycol dimethacrylate, diethylene glycol dimethacrylate, triethylene glycol diacrylate, dipropylene glycol dimethacrylate, polypropylene glycol dimethacrylate, and diallyl phthalate.

The added amount of a crosslinking agent is from 0.05 to 15 parts by weight, and preferably from 0.1 to 10 parts by weight, based on 100 parts by weight of an addition polymerizable monomer. When the added amount is too small, the effect of the crosslinking agent cannot be produced. In contrast, when the added amount is too large, the crosslinked binder resin cannot be melted upon application of heat thereto, namely, a toner image cannot be well fixed with a heat fixing device.

When an addition polymerizable monomer is polymerized, a polymerization initiator is used. Specific examples of such a polymerization initiator include azo or diazo polymerization initiators such as 2,2'-azobis(2,4-dimethylvaleronitrile), and 2,2'-azobisisobutyronitrile; peroxide polymerization initiators such as benzoyl peroxide, methyl ethyl ketone peroxide, and 2,4-dichlorobenzoyl peroxide; etc.

These polymerization initiators can be used in combination, for example, to control the molecular weight and molecular weight distribution.

The added amount of such a polymerization initiator is from 0.05 to 15 parts by weight, and preferably from 0.5 to 10 parts by weight, based on 100 parts by weight of the addition polymerizable monomer used.

In addition, the hybrid resin (3) can also be prepared by performing polymerization in the same reaction vessel using monomers for the resins (1) and (2), and another monomer (hereinafter referred to as bireactive monomer) which can be reacted with the monomers for forming the resins (1) and (2). Specific examples of such a bireactive monomer include fumaric acid, acrylic acid, methacrylic acid, maleic acid, dimethyl fumarate, etc.

The added amount of a bireactive monomer is from 1 to 25 parts by weight, and preferably from 2 to 10 parts by weight, based on 100 parts by weight of the monomers used for preparing an addition polymerization polymer. When the added amount is too small, a colorant and a charge controlling agent cannot be well dispersed in the resultant binder resin, resulting in deterioration of image qualities (such as occurrence of a background development problem in that the background of an image is soiled with toner particles). In contrast, when the added amount is too large, a problem in that the resultant polymer gelates tends to be caused.

As mentioned above, hybrid resins (3) can be prepared by performing both the reactions (i.e., condensation polymerization and addition polymerization) in the same reaction vessel in such a manner that both the reactions proceed and/or complete at the same time (i.e., parallel reaction). In addition, hybrid resins (3) can also be prepared by performing the two reactions independently, for example, by properly changing the reaction temperature or the reaction time.

For example, the following method can be used.

(1) In a reaction vessel, a mixture including one or more addition polymerizable vinyl monomers and a polymerization initiator is dropped into a mixture of condensation polymerizable monomers for preparing a polyester resin to prepare a monomer mixture;

(2) at first performing a radical reaction (i.e., addition polymerization) at a relatively low reaction temperature to prepare a vinyl resin; and (3) then increasing the reaction temperature to perform a condensation polymerization reaction to prepare a polyester resin.

By using this method in which two reactions are performed independently, a resin dispersion in which two kinds of resins are dispersed can be efficiently produced.

The added amounts of a nonlinear polymer (1), a linear polymer (2) and a hybrid resin (3) is from 30 to 70 parts by weight, from 30 to 70 parts by weight, and from 5 to 30 parts by weight, respectively, based on 100 parts by weight of all the binder resins used for preparing the toner.

It is preferable that the nonlinear polymer (1) has an acid value of from 20 to 70 mgKOH/g, or the linear polymer (2) has an acid value of from 7 to 70 mgKOH/g to impart a good combination of low temperature fixability and environmental stability to the resultant toner. By using a resin having a relatively high acid value as the binder resin, the resultant toner has good affinity for receiving materials such as papers, thereby improving the low temperature fixability of the toner. When the acid value is not greater than 70 mgKOH/g, the toner is hardly influenced by moisture in the air, and thereby the charge quantity of the toner is stabilized even when environmental conditions vary.

Next, the polymer chain growing reaction method for forming the toner for use in the present invention will be explained.

The polymer chain growing reaction method typically includes the following steps:

(1) Dissolving or dispersing toner constituents including at least a reactive prepolymer, which can perform a polymer chain growing reaction, a colorant, and a release agent in an oily solvent to prepare an oily mixture liquid;

(2) Dispersing the oily mixture liquid in an aqueous medium in the presence of a particulate polymer to prepare an emulsion;

(3) Subjecting the emulsion to a polymer chain growing reaction to prepare a dispersion of toner particles; and (4) Removing the solvents from the toner particle dispersion to obtain toner particles.

The resultant toner particles preferably have an average volume particle diameter of from 4.0 μm to 7.0 μm.

Specific examples of the resins for use as the reactive prepolymer include polyester resins, epoxy resins, acrylic resins, etc. Suitable reactions for use in the polymer chain growing reaction include urethane bond/urea bond reactions, epoxy reactions, and ester reactions. Among these resins, polyester resins are preferably used as reactive prepolymers.

Since polyester resins have relatively low softening points while having relatively high glass transition temperatures, a good combination of low temperature fixability and preservation stability can be imparted to the resultant toner. In addition, the ester bond of polyester resins has good affinity for papers which are typically used as image receiving materials, and therefore good offset resistance can be imparted to the resultant toner. Thus, polyester resins are preferably used for preparing low temperature fixable toner.

The binder resin of the toner for use in the present invention preferably includes a polyester resin (such as urea-modified polyester resins) prepared by a polymer chain growing reaction, or a combination of such a polyester resin and a non-reactive polyester resin.

Hereinafter, a case of using a combination of such a modified polyester resin and a non-reactive polyester resin will be explained.

Urea-modified polyester resins can be prepared by reacting a polyester prepolymer (A) having an isocyanate group (which will be mentioned below) with an amine (B).

Such a polyester prepolymer (A) having an isocyanate group can be prepared by reacting a polyester resin, which is prepared by subjecting a polyol (PO) and a polycarboxylic acid (PC) to a condensation polymerization reaction and which has an active hydrogen atom (2), with a polyisocyanate (PIC).

Specific examples of the groups having such an active hydrogen atom include hydroxyl groups (alcoholic hydroxyl groups and phenolic hydroxyl groups), amino groups, carboxyl groups, and mercapto groups. Among these groups, alcoholic hydroxyl groups are preferable.

Specific examples of the polyols for use in preparing polyester resins include diols (DIO) and polyols (TO) having three or more hydroxyl groups. It is preferable to use diols (DIO) or mixtures of a diol (DIO) and a small amount of polyol (TO) as the polyol (PO).

Specific examples of such diols (DIO) include alkylene glycols such as ethylene glycol, 1,2-propylene glycol, 1,3-propylene glycol, 1,4-butane diol, and 1,6-hexane diol; alkylene ether glycols such as diethylene glycol, triethylene glycol, dipropylene glycol, polyethylene glycol, polypropylene glycol, and polytetramethyleneether glycol; alicyclic diols such as 1,4-cyclohexane dimethanol, and hydrogenated bisphenol A; bisphenol compounds such as bisphenol A, bisphenol F, and bisphenol S; adducts of the above-mentioned alicyclic diols with an alkylene oxide (such as ethylene oxide, propylene oxide and butylene oxide); adducts of the above-mentioned bisphenol compounds with an alkylene oxide (such as ethylene oxide, propylene oxide and butylene oxide); etc.

These polyols can be used alone or in combination.

Among these polyols, aliphatic diols such as alkylene glycols having 2 to 12 carbon atoms, and alkylene glycol adducts of bisphenol compounds are preferable, and alkylene glycol adducts of bisphenol compounds, and combinations of an alkylene glycol adduct of bisphenol compound and an alkylene glycol having 2 to 12 carbon atoms are more preferable.

Specific examples of the polyols (TO) include aliphatic alcohols having three or more hydroxyl groups (e.g., glycerin, trimethylol ethane, trimethylol propane, pentaerythritol, and sorbitol); polyphenols having three or more hydroxyl groups (trisphenol PA, phenol novolak, and cresol novolak); adducts of the above-mentioned polyphenols with an alkylene oxide; etc.

Dicarboxylic acids (DIC) and polycarboxylic acids (TC) having three or more carboxyl groups are used as the polycarboxylic acid (PC). It is preferable to use dicarboxylic acids (DIC) or mixtures of a small amount of polycarboxylic acid (TC) and a dicarboxylic acid (DIC) as the polycarboxylic acid (PC).

Specific examples of the dicarboxylic acids (DIC) include alkylene dicarboxylic acids (such as succinic acid, adipic acid, and sebacic acid); alkenylene dicarboxylic acids (such as maleic acid, and fumaric acid); aromatic dicarboxylic acids (such as phthalic acid, isophthalic acid, terephthalic acid, and naphthalene dicarboxylic acids; etc. Among these compounds, alkenylene dicarboxylic acids having from 4 to 20 carbon atoms, and aromatic dicarboxylic acids having from 8 to 20 carbon atoms are preferably used.

Specific examples of the polycarboxylic acids (TC) include aromatic polycarboxylic acids having from 9 to 20 carbon atoms (such as trimellitic acid, and pyromellitic acid).

In the reaction of a polycarboxylic acid (PC) with a polyol (PO), anhydrides or lower alkyl esters (such as methyl esters, ethyl esters, or isopropyl esters) of the polycarboxylic acids mentioned above can also be used as the polycarboxylic acid (PC).

Suitable mixing ratio of a polyol (PO) to a polycarboxylic acid (PC) (i.e., an equivalence ratio [OH]/[COOH]) of the hydroxyl group of a polyol (PO) to the carboxyl group of a polycarboxylic acid (PC)) is from 2/1 to 1/1, preferably from 1.5/1 to 1/1 and more preferably from 1.3/1 to 1.02/1.

Specific examples of the polyisocyanates (PIC) include aliphatic polyisocyanates (such as tetramethylene diisocyanate, hexamethylene diisocyanate, and 2,6-diisocyanato methylcaproate); alicyclic polyisocyanates (such as isophorone diisocyanate, and cyclohexylmethane diisocyanate); aromatic didicosycantes (such as tolylene diisocyanate, and diphenylmethane diisocyanate); aromatic aliphatic diisocyanates (such as α,α,α',α'-tetramethyl xylylene diisocyanate); isocyanurates; blocked polyisocyanates in which the polyisocyanates mentioned above are blocked with phenol derivatives, oximes, or caprolactams; etc. These compounds can be used alone or in combination.

Suitable mixing ratio of a polyisocyanate (PIC) to a polyester having a hydroxyl group (i.e., an equivalence ratio [NCO]/[OH] of the isocyanate group of a polyisocyanate (PIC) to the hydroxyl group of a polyester) is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the [NCO]/[OH] ratio is too small, the content of the urea group in the resultant modified polyester decreases and thereby the hot-offset resistance of the toner is deteriorated.

The content of the constitutional component of a polyisocyanate (PIC) in the polyester prepolymer (A) having a polyisocyanate group at its end portion is from 0.5% to 40% by weight, preferably from 1% to 30% by weight, and more preferably from 2% to 20% by weight. When the content is too low, the hot offset resistance of the toner deteriorates, and in addition it is difficult to impart a good combination of heat resistance and low temperature fixability to the toner. In contrast, when the content is too high, the low temperature fixability of the toner deteriorates.

The number of the isocyanate group included in a molecule of the polyester prepolymer (A) is not less than 1, preferably from 1.5 to 3, and more preferably from 1.8 to 2.5. When the number of the isocyanate group is too small, the molecular weight of the resultant urea-modified polyester decreases and thereby the hot offset resistance of the toner is deteriorated.

By reacting an amine (B) with the polyester prepolymer (A), a urea-modified polyester resin (UMPE) can be prepared. Specific examples of the amine (B) include diamines (B1), polyamines (B2) having three or more amino groups, amino alcohols (B3), amino mercaptans (B4), amino acids (B5), and blocked amines (B6) in which the amines (B1-B5) mentioned above are blocked.

Specific examples of the diamines (1) include aromatic diamines (such as phenylenediamine, diethyltoluene diamine and 4,4'-diaminodiphenyl methane); alicyclic diamines (such as 4,4'-diamino-3,3'-dimethyldicyclohexyl methane, diaminocyclohexane, and isophoron diamine); aliphatic diamines (such as ethylene diamine, tetramethylene diamine, and hexamethylene diamine); etc.

Specific examples of the polyamines (B2) having three or more amino groups include diethylene triamine, triethylene tetramine, etc.

Specific examples of the amino alcohols (B3) include ethanol amine, hydroxyethyl aniline, etc.

Specific examples of the amino mercaptans (B4) include aminoethyl mercaptan, aminopropyl mercaptan, etc.

Specific examples of the amino acids (B5) include amino propionic acid, amino caproic acid, etc.

Specific examples of the blocked amines (B6) include ketimine compounds which are prepared by reacting one of the amines B1-B5 mentioned above with a ketone such as acetone, methyl ethyl ketone, and methyl isobutyl ketone; oxazoline compounds; etc.

Among these compounds, diamines (B1), and mixtures in which a diamine (B1) is mixed with a small amount of polyamine (B2) are preferable.

The molecular weight of the urea-modif ied polyester (UMPE) can be controlled using a molecular weight control agent, if desired. Specific examples of such a molecular weight control agent include monoamines (e.g., diethyl amine, dibutyl amine, butyl amine, and lauryl amine), and blocked amines (i.e., ketimine compounds) in which the monoamines mentioned above are blocked.

The mixing ratio of a polyester prepolymer (A) having an isocyanate group to an amine (B) (i.e., an equivalence ratio [NCO]/[NHx] of the isocyanate group of a polyester prepolymer (A) to the amino group of an amine) is from 1/2 to 2/1, preferably from 1.5/1 to 1/1.5, and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyester (UMPE) can include an urethane bond as well as a urea bond.

Amines (B) serve as crosslinking agents or molecular chain growing agent for polyester prepolymers (A) reactive with an active hydrogen atom.

Urea-modified polyesters (UMPE) can be prepared, for example, by a method such as one-shot methods or prepolymer methods. The weight average molecular weight of such urea-modified polyesters is not less than 10,000, preferably from 20,000 to 10,000,000, and more preferably from 30,000 to 1,000,000. When the weight average molecular weight is too low, the hot offset resistance of the resultant toner deteriorates.

The above-mentioned nonreactive polyester resins for use in the toner is synthesized by subjecting an acid component and an alcohol component to a condensation reaction, subjecting a cyclic ester to a ring-opening reaction, or subjecting a halogen compound, an alcohol component, and carbon oxide to a reaction.

Hereinafter, monomers for use in preparing such nonreactive polyester resins will be explained.

Suitable materials for use as the alcohol component include di- or more-hydric alcohols. Suitable materials for use as the acid component include di- or more-basic acids.

Specific examples of the dihydric alcohols include diols such as ethylene glycol, triethylene glycol, 1,2-propylene glycol, 1,3-propylene glycol, 1,4-butane diol, neopentyl glycol, 1,4-butene diol, 1,5-pentane diol, and 1,6-hexane diol; bisphenol A; hydrogenated bisphenol A; α,α'-bis(4-hydroxyphenyl)-1,4-diisopropylbenzene; alkylene oxide adducts of the bisphenol compounds (such as polyoxyethylene bisphenol A, and polyoxypropylene bisphenol A); etc.

Specific examples of the tri- or more-hydric alcohols include sorbitol, 1,2,3,6-hexanetetrol, 1,4-sorbitan, pentaerythritol, sucrose, 1,2,4-butanetriol, 1,2,5-pentanetriol, glycerol, 2-methylpropanetriol, 2-methyl-1,2,4-butanetriol, trimethylol methane, trimethylol ethane, trimethylol propane, 1,3,5-trihydroxymethylbenzene, etc.

Specific examples of the dibasic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and other organic acids.

Specific examples of the tri- or more-basic acids include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,5-hexanetricarboxylic acid, 1,3-dicarboxyl-2-methyl-2-carboxymethylpropane, tetra(carboxymethyl)methane, 1,2,7,8-octanetetracarboxylic acid, etc.

Anhydrides and halogenated compounds of these organic acids can also be used as the acid components for use in synthesizing nonreactive polyester resins.

Specific examples of other acid components for use in preparing nonreactive polyester resins include polyhalogenated compounds such as cis-1,2-dichloroethene, trans-1,2-dichloroethene, 1,2-dichloropropene, 1,3-dichloropropene, o-dichlorobenzene, m-dichlorobenzene, p-dichlorobenzene, o-dibromobenzene, m-dibromobenzene, p-dibromobenzene, o-chlorobromobenzene, dichlorocyclohexane, dichloroethane, 1,4-dichlorobutane, 1,8-dichlorooctane, 1,7-dichlorooctane, dichloromethane, 4,4'-dibromovinylphenol, 1,2,4-tribromobenzene, etc.

At least one of the acid component and the alcohol component used for preparing the nonreactive polyester resins preferably includes an aromatic ring.

The mixing ratio of an acid component to an alcohol component (i.e., an equivalence ratio [OH]/[COOH] of the hydroxyl group of an alcohol component to the carboxyl group of an acid component) is from 0.9 to 1.5, and preferably from 1.0 to 1.3. In this regard, halogenated carboxylic acids can also be used as the acid component.

Other additives such as amine components can be added when preparing the above-mentioned nonreactive polyester resins. Specific examples thereof include triethyl amine, trimethyl amine, N,N-dimethyl aniline, etc.

Alternatively, the nonreactive polyester resins may be synthesized using a condensation agent such as dicyclohexylcarbodiimide.

The toner for use in the present invention includes a colorant. Specific examples of such a colorant include known dyes and pigments such as carbon black, lamp black, iron black, aniline blue, Phthalocyanine Blue, Phthalocyanine Green, HANSA YELLOW C, Rhodamine 6C Lake, chalco-oil blue, chrome yellow, Quinacridone, BENZIDINE YELLOW, Rose Bengal, triarylmethane dyes, etc. These dyes and pigments can be used alone or in combination to prepare black toners or full color toners.

The content of a colorant in the toner is from 1% to 30% by weight, and preferably from 3% to 20% by weight, based on the weight of the binder resin component included in the toner.

The toner for use in the present invention includes a release agent. Any known release agents such as carnauba waxes, montan waxes, oxidized rice waxes, synthesized ester waxes, solid silicone varnishes, higher fatty acids, higher alcohols, montan ester waxes, and low-molecular weight polypropylene waxes can be used. These release agents can be used alone or in combination. Among these release agents, carnauba waxes, montan waxes, oxidized rice waxes, and synthesized ester waxes are preferably used because of imparting a good combination of low temperature fixability and hot offset resistance to the toner.

Carnauba waxes are natural waxes prepared from leaves of carnauba palm trees. Among these carnauba waxes, microcrystalline carnauba waxes, which preferably have an acid value of not greater than 5 mgKOH/g, are preferably used because of being able to be well dispersed in a binder resin. It is more preferable to use low-acid-value carnauba waxes, which are prepared by subjecting carnauba waxes to a free fatty acid removing treatment to decrease the acid value.

In the present application, montan waxes mean montan waxes prepared by refining montan waxes obtained from minerals. Among these montan waxes, microcrystalline montan waxes, which preferably have an acid value of from 5 to 14 mgKOH/g, are preferably used.

Oxidized rice waxes are natural waxes prepared by refining raw waxes produced in a dewaxing or winterization process when refining a rice bran oil extracted from rice bran. Among these oxidized rice waxes having an acid value of from 10 to 30 mgKOH/g are preferably used.

Synthesized ester waxes are synthesized by subjecting a monofunctional linear fatty acid and a monofunctional linear alcohol to an ester reaction.

The added amount of a release agent is from 1 to 15 parts by weight, and preferably from 2 to 10 parts by weight, based on 100 parts by weight of the binder resin component included in the toner. By controlling the added amount in this range, the amount of the release agent present on the surface of toner particles can be controlled in a proper range, thereby imparting a good combination of filming resistance and offset resistance to the toner. In addition, the amount of the release agent present on the surface of toner particles can also be controlled by adjusting the shear force applied to a toner constituent mixture in a kneading process (for example, by properly controlling the kneading temperature) when the toner is prepared by a kneading method.

The toner of the present invention can include a charge controlling agent. Known charge controlling agents for use in conventional toners can be used for the toner for use in the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as sulfonate, carboxyl, and quaternary ammonium salt groups.

The content of a charge controlling agent in the toner is not unambiguously determined, and is determined depending on variables such as choice of binder resin, presence of additives, and toner manufacturing method (such as toner constituent dispersing method). However, the content is typically from 0.1 to 10 parts by weight, and preferably from 0.2 to 5 parts by weight, based on 100 parts by weight of the binder resin included in the toner. When the content is too low, the charge controlling effect cannot be well produced. When the content is too large, the toner is excessively charged, thereby deteriorating the effect of a main charge controlling agent, and seriously increasing the electrostatic attraction between the toner and the developing roller, resulting in deterioration of fluidity of the toner, and formation of images with low image density.

The toner for use in the present invention can include a fluidity improving agent. Specific examples thereof include known fluidity improving agents such as silicon oxide, titanium oxide, silicon carbide, aluminum oxide, and barium titanate. These fluidity improving agents can be used alone or in combination.

The content of a fluidity improving agent in the toner is from 0.1 to 5 parts by weight, and preferably from 0.5 to 2 parts by weight, based on 100 parts by weight of the toner.

The toner for use in the present invention preferably has a weight average particle diameter (D4) of from 4 μm to 7.5 μm, and more preferably from 5 μm to 7 μm. In addition, the toner preferably has a particle diameter distribution such that particles having a particle diameter of not greater than 5 μm are included in the toner in an amount of from 60% to 80% by number, and more preferably from 65% to 75% by number. When the toner has such properties, high resolution images can be produced while preventing occurrence of a filming problem in that the toner is adhered to image forming members such as image bearing members, which is typically caused by relatively fine particles including a release agent in a relatively large amount.

In the present application, the weight average particle diameter (D4) and the content of particles having a particle diameter of not greater than 5 μm are measured, by an instrument COULTER COUNTER TA-II manufactured by Beckman Coulter Inc. Specifically, Coulter counter TA-II is used together with an interface which can output particle diameter distributions on number basis and volume basis and which is manufactured by Nikkaki Bios Co., Ltd. and a personal computer. The procedure is as follows:

(1) A surfactant serving as a dispersant, preferably 0.1 to 5 ml of a 1% aqueous solution of an alkylbenzenesulfonic acid salt, is added to an electrolyte such as 1% aqueous solution of first class NaCl;

(2) One (1) milligram to 10 mg of a sample (toner) to be measured is added into the mixture prepared above;

(3) The mixture is subjected to an ultrasonic dispersion treatment for about 1 minute;

(4) The dispersion is fed into a beaker containing 100 ml to 200 ml of the electrolyte such that the concentration of the sample becomes the predetermined concentration; and (5) The thus prepared dispersion of the sample is fed into the instrument (COULTER COUNTER TA-II) equipped with an aperture of 100 μm to measure the particle diameter distribution of 30,000 particles having a particle diameter of from 2 to 40 μm and to determine the volume-basis particle diameter distribution and number-basis particle diameter distribution of the sample (toner).

The weight average particle diameter (D4) is determined on the basis of the volume-based particle diameter distribution.

The toner for use in the present invention preferably has a molecular weight distribution determined by gel permeation chromatography (GPC) such that at least one peak is present in a molecular weight range of from 1,000 to 10,000, and the peak has a half width of not greater than 15,000, and preferably not greater than 10,000. In this case, the toner has good heat response, i.e., the toner has good low temperature fixability.

In the present application, the molecular weight distribution of a resin can be measured by gel permeation chromatography (GPC). The method is as follows.

(1) The column is stabilized in a chamber heated to 40° C.;

(2) Tetrahydrofuran (THF) is passed through the column heated to 40° C. at a flow rate of 1 ml/min; and (3) Then 50 μl to 200 μl of a 0.05% to 0.6% by weight THF solution of a sample is injected into the column to determine the molecular weight distribution of the sample.

The molecular weight distribution of the sample is determined using a working curve which represents the relationship between weight and GPC counts and which is previously prepared using monodisperse polystyrenes. Specific examples of the molecular weights of the monodisperse polystyrenes include $6\times10^2$, $2.1\times10^3$, $4\times10^3$, $1.75\times10^4$, $1.1\times10^5$, $3.9\times10^5$, $8.6\times10^5$, $2\times10^5$, and $4.48\times10^6$. The monodisperse polystyrenes can be available from Pressure Chemical Co., or Tosoh Corp. It is preferable to prepare a working curve using tenor more kinds of monodisperse polystyrenes. In measurements, it is preferable to use a RI (refractive index) detector as the detector.

When the toner for use in the present invention includes chloroform-insoluble components in an amount of from 5% to 40% by weight, the resultant toner can have good offset resistance with sufficient tolerance without deteriorating the low temperature fixability.

The content of chloroform-insoluble components in a toner can be determined by the following method:

(1) About 1.0 g of toner is precisely weight;

(2) About 50 g of chloroform is added to the toner;

(3) The mixture is subjected to a centrifugal separation treatment followed by filtering using a filter paper No. 5C, which is specified in Japanese Industrial Standards (JIS) P3801 and whose weight is previously measured; and (4) After the residue on the filter paper is dried, the weight thereof is measured to determine the weight of the residue (i.e., chloroform-insoluble components).

The content (C) of chloroform-insoluble components in the toner is determined by the following equation:

$$C(\%\text{ by weight})=(R/T)\times100$$

wherein R represents the weight of the residue, and T represents the weight of the toner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Preparation Examples

I. Preparation of Toner A

1. Preparation of Hybrid Resin

The following components were mixed to prepare an addition polymerizable monomer mixture.

| Addition polymerizable monomers | |
|---|---|
| Styrene | 20 moles |
| Butyl methacrylate | 5 moles |
| Addition polymerization initiator | |
| t-butylhydroperoxide | 0.4 moles |

The thus prepared addition polymerizable monomer mixture (hereinafter referred to as a mixture (1)) was contained in a dropping funnel.

On the other hand, the following components were mixed to prepare a mixture (2) of a bireactive monomer (i.e., an addition polymerizable/condensation polymerizable monomer) and a condensation polymerizable monomer mixture.

| | |
|---|---|
| Bireactive monomer | |
| Fumaric acid | 10 moles |
| Condensation polymerizable monomers | |
| Trimellitic anhydride | 4 moles |
| Propylene oxide (2.2) adduct of bisphenol A | 6 moles |
| Ethylene oxide (2.2) adduct of bisphenol A | 4 moles |
| Esterification catalyst | |
| Dibutyltin oxide | 0.6 mol |

The thus prepared mixture (2) of the bireactive monomer and the condensation polymerizable monomer mixture were fed into a flask equipped with a stainless agitator, a falling-type condenser, a nitrogen gas feed pipe, and a thermometer.

The mixture (2) in the flask was heated to 135° C. in a nitrogen atmosphere while agitated, and the mixture (1) was dropped into the mixture (2) from the dropping funnel over 5 hours.

After all the mixture (1) was fed into the mixture (2), the resultant mixture was aged for 6 hours at 135° C. Next, the temperature of the mixture was increased to 220° C. to perform a condensation reaction. After the reaction, the reaction product was extracted from the flask, followed by cooling and pulverizing, to prepare a particulate hybrid resin.

The above-mentioned reaction was performed while occasionally checking the softening point of the polymer by a method described in JIS K7210, which is the same as ASTM E28-67. The method is described above. When the polymer had the predetermined softening point, the reaction was stopped.

2. Preparation of Nonlinear Polyester Resin

A nonlinear polyester resin was prepared by reacting the following monomers.

| | |
|---|---|
| Fumaric acid | 10 moles |
| Trimellitic acid | 4 moles |
| Propylene oxide (2.2) adduct of bisphenol A | 6 moles |
| Ethylene oxide (2.2) adduct of bisphenol A | 4 moles |

It was confirmed that the thus prepared nonlinear polyester resin has an acid value of 16.3 mgKOH/g, a hydroxyl value of 35.1 mgKOH/g, a softening point of 45.1° C., a glass transition temperature of 61.5° C., and a molecular weight distribution property such that the peak molecular weight (Mp) is 4,000, and the half width of the peak is 10,000. In this regard, the acid value and hydroxyl value were determined by a method described in JIS K0070.

3. Preparation of Linear Polyester Resin

A linear polyester resin was prepared by reacting the following monomers.

| | |
|---|---|
| Terephthalic acid | 8 moles |
| Propylene oxide (2.2) adduct of bisphenol A | 6 moles |
| Ethylene oxide (2.2) adduct of bisphenol A | 4 moles |

It was confirmed that the thus prepared nonlinear polyester resin has an acid value of 2.1 mgKOH/g, a hydroxyl value of 34 mgKOH/g, a softening point of 100.8° C., a glass transition temperature of 60.3° C., and a molecular weight distribution property such that the peak molecular weight (Mp) is 6,000, and the half width of the peak is 22,000.

4. Preparation of Toner

The following components were mixed.

| | |
|---|---|
| Nonlinear polyester resin prepared above | 40 parts |
| Linear polyester resin prepared above | 50 parts |
| Low molecular weight polyethylene (having average particle diameter of 600 μm, and circularity of 0.85) | 5 parts |
| Carbon black (#44 from Mitsubishi Chemical Corp.) | 10 parts |
| Zinc complex of 3,5-di-tert-butylsalycilic acid | 5 parts |
| Hybrid resin prepared above | 10 parts |

The mixture was well agitated using a HENSCHEL MIXER mixer, followed by roll milling for about 30 minutes at 130° C. After being cooled, the kneaded mixture was crushed with a hammer mill so as to have particle diameters of from 20 μm to 400 μm. The crushed material was then subjected to a pulverization/classification treatment using a pulverization/classification device IDS-2 from Nippon Pneumatic Mfg. Co., Ltd. having a pulverizer in which the crushed material is directly collided with a collision plate using jet air to be pulverized, and a classifier in which the pulverized material is subjected to a centrifugal classification treatment in a classification chamber using rotationally flowing air to prepare mother toner particles. In this regard, the average particle diameter of the mother toner particles can be controlled by adjusting the following factors:

(1) Amount of the crushed material supplied to the pulverization/classification device;

(2) Pressure and flow rate of high pressure air supplied for pulverization;

(3) Shape of the collision plate;

(4) Flowing position and flowing direction of air in the classifier; and (5) Air pressure of the exhaust blower used for the classifier.

The average particle diameter of the mother toner particles can be measured with an instrument, COULTER COUNTER TA-II from Beckman Coulter Inc.

The following components were mixed using a HENSCHEL MIXER mixer to prepare a toner A.

| | |
|---|---|
| Mother toner particles prepared above | 100 parts |
| Hydrophobized silica (R972 from Nippon Aerosil Co., which is treated with dichlorodimethyl silane and has an average primary particle diameter of 0.016 μm) | 0.6 parts |
| Hydrophobized titanium oxide | 0.2 parts |

(T805 from Nippon Aerosil Co., which is treated with octyltrimethoxy silane and has an average primary particle diameter of 0.02 μm)

It was confirmed that the toner A has a softening point of 130° C.

II. Preparation of Toner B

At first, an unmodified polyester resin (a) was prepared by reacting an ethylene oxide (2 mol) adduct of bisphenol A, terephthalic acid, and phthalic anhydride. In addition, a prepolymer (b) having an isocyanate group and having a weight average molecular weight of 35,000 was prepared by reacting an ethylene oxide (2 mol) adduct of bisphenol A, isophthalic acid, terephthalic acid, phthalic anhydride, and isophorone diisocyanate.

In addition, a ketimine compound (c) was prepared using isophorone diamine and methyl ethyl ketone.

Next, the following components were mixed in a beaker while agitated to prepare a resin solution.

| | |
|---|---|
| Unmodified polyester resin (a) | 55 parts |
| Prepolymer (b) | 20 parts |
| Ethyl acetate | 78.6 parts |

In addition, 10 parts of a rice wax which serves as a release agent and has a melting point of 61° C., and 4 parts of a carbon black serving as a colorant were fed into the resin solution. The mixture was agitated for 5 minutes at 40° C. using a TK HOMOMIXER mixer (from Tokushu Kika Kogyo Co., Ltd.) whose rotor was rotated at a revolution of 12,000 rpm. The mixture was then dispersed for 30 minutes at 20° C. using a bead mill. Thus, a toner constituent mixture oily dispersion (d) was prepared.

On the other hand, the following components were fed into a beaker to prepare an aqueous medium (e).

| | |
|---|---|
| Ion-exchange water | 306 parts |
| 10% suspension of tricalcium phosphate | 265 parts |
| Sodium dodecylbenzene sulfonate | 0.2 parts |

The toner constituent mixture oily dispersion (d) prepared above and 2.7 parts of the ketimine compound (c) prepared above were fed into the aqueous medium (e) agitated in the beaker with a TK HOMOMIXER mixer (from Tokushu Kika Kogyo Co., Ltd.) whose rotor was rotated at a revolution of 12,000 rpm. The mixture was agitated with the TK HOMOMIXER mixer to perform a urea reaction, resulting in formation of a dispersion.

The thus prepared dispersion, which has a viscosity of 3500 Pa·s, was subjected to a solvent removing treatment for not longer than 1.0 hour at a temperature of not higher than 50° C. under a reduced pressure, followed by filtering, washing, drying and air classification treatments. Thus, spherical mother toner particles (f) were prepared.

The following components were fed into a Q-form mixer from Mitsui Mining Co., Ltd. to be subjected a mixing treatment.

| | |
|---|---|
| Mother toner particles (f) prepared above | 100 parts |
| Charge controlling agent (BONTRON E-84 from Orient Chemical Industries Co., Ltd.) | 0.25 parts |

The mixing conditions were as follows.

Peripheral velocity of turbine blade: 50 m/sec

Mixing treatment: An operation in which mixing is performed for 2 minute, followed by pause for 1 minute is repeated 5 times (5 cycles in total (the total mixing time is 10 minutes)).

Further, 0.5 parts of a hydrophobized silica (H2000 from Clariant Japan K.K.) was added to the mixture, followed by a mixing treatment using the Q-form mixer under the following conditions.

Peripheral velocity of turbine blade: 15 m/sec

Mixing treatment: An operation in which mixing is performed for 0.5 minute, followed by pause for 1 minute is repeated 5 times.

Thus, a toner B was prepared. It was confirmed that the binder resin of the toner B has a softening point of 115° C.

Example 1

A developing roller was prepared as follows.

1. Preparation of Coating Liquid for Forming Insulating Layer

The following components were mixed to prepare an insulating layer coating liquid.

| | |
|---|---|
| Alkyd resin (BECKOLITE M-6401-50 from Dainippon Ink And Chemicals, Inc.) | 30 parts |
| Melamine resin (SUPER BECKAMINE G-821-60 from Dainippon Ink And Chemicals, Inc.) | 20 parts |
| 2-Butanone | 60 parts |

2. Preparation of Coating Liquid A for Forming Outermost Layer

The following components were mixed to prepare an outermost layer coating liquid.

| | |
|---|---|
| Tetrahydrofuran | 70 parts |
| Cyclohexanone | 20 parts |
| Bisphenol Z-form polycarbonate resin (PANLITE TS-2050 from Teijin Chemicals Ltd.) | 10 parts |
| Silicone oil (KF-50 from Shin-Etsu Chemical Co., Ltd.) | 0.002 parts |

3. Preparation of Developing Roller

A cylindrical aluminum tube having a diameter of 16 mm and a length of 230 mm was dipped into the above-prepared insulating layer coating liquid to form an insulating layer with a thickness of 20 μm, followed by heating for 5 minutes at 120° C. to crosslink the layer. Thus, the substrate 9*a* having an insulating layer thereon was prepared.

A copper film with a thickness of 0.8 μm was formed on the insulating layer by a vapor deposition method. In addition, a resist film with a thickness of 5 μm was formed on the copper film. A laser image forming device irradiated the resist film with laser light to draw a latent image of the patterned electrode (9*b*) in which plural linear electrodes 9*b*A and 9*b*B each having a width d of 100 μm and a length of 200 mm are arranged at regular intervals C of 200 μm, followed by a development process in which the latent image is developed with an aqueous solution of sodium carbonate ($Na_2CO_3$), and an etching process in which the developed image is dipped into an aqueous solution of ferric chloride ($FeCl_3$) Thus, the patterned electrode 9*b* having the electrodes 9*b*A and 9*b*B was prepared.

Next, the above-prepared outermost layer coating liquid A was coated on the patterned electrode 9*b* in such a manner that both the end portions 9*b*A1 and 9*b*B1 of the electrodes 9*b*A and 9*b*B are exposed without covered with the outermost layer to prepare the outermost layer 9*c* with a thickness of 10 μm. In this example, the outermost layer was subjected to a heat treatment to be crosslinked while removing the solvents therefrom, although the outermost layer can be crosslinked at room temperature.

The thus prepared developing roller 9 was incorporated into the developing device 4. An alternate voltage having peaks at −400V and 0V and an average potential of −200V while having a frequency of 5 KHz was applied by a power source to each of the terminals 13A and 13B provided at the opening 8*a* of the developing device 4. In this regard, the alternate voltage applied to the odd-numbered electrodes 9*b*A has a phase opposite to the alternate voltage applied to the even-numbered electrodes 9*b*B.

This developing device was set in the black image forming station of an image forming apparatus IPSIO CX3500 from Ricoh Co., Ltd., to perform a running test in which 50,000 images are produced using the toner A prepared above. In this regard, at the beginning and end of the running test, the following evaluations were performed.

1. Observation of Toner Particles Hopping on the Developing Roller

A new developing roller was set and 10 images of an original image were continuously produced while observing whether the toner causes abnormal hopping. In addition, after the 50,000-copy running test, 10 images of the original image were continuously produced while observing whether the toner causes abnormal hopping.

2. Observation of Produced Images to Determine Whether or not Abnormal Images are Formed.

The 10 images produced before the running test and the images produced after the running test were visually observed to determine whether the images have abnormal images.

Example 2

The procedure for preparation and evaluation of the developing device in Example 1 was repeated except that the toner A was replaced with the toner B.

Comparative Example 1

The insulating layer coating liquid used for forming the insulating layer in Example 1 was used as an outermost layer coating liquid B.

The procedure for preparation and evaluation of the developing device in Example 1 was repeated except that the outermost layer coating liquid A was replaced with the outermost layer coating liquid B.

Comparative Example 2

The procedure for preparation and evaluation of the developing device in Comparative Example 1 was repeated except that the toner A was replaced with the toner B.

Comparative Example 3

The procedure for preparation and evaluation of the developing device in Example 1 was repeated except that the outermost layer was formed by spray-coating a silicone resin RSR213 from Dow Corning Toray Silicone Co., Ltd., which serves as an outermost layer coating liquid C.

Comparative Example 4

The procedure for preparation and evaluation of the developing device in Comparative Example 3 was repeated except that the toner A was replaced with the toner B.

Comparative Example 5

The procedure for preparation and evaluation of the developing device in Example 1 was repeated except that the outermost layer coating liquid A was replaced with an outermost layer coating liquid D, which was prepared by dissolving 89 parts of a noncrystalline polyester resin VYLON 20SS (a thermoplastic resin having good adhesiveness manufactured by Toyobo Co., Ltd.), and 143 parts of a melamine resin (CYMEL 325 from MT AquaPolymer, Inc.) in 238 parts of methyl ethyl ketone.

Comparative Example 6

The procedure for preparation and evaluation of the developing device in Comparative Example 5 was repeated except that the toner A was replaced with the toner B.

Comparative Example 7

The procedure for preparation and evaluation of the developing device in Comparative Example 5 was repeated except that the developing roller was set in a conventional contact one-component developing device in which toner particles are rubbed with a developer layer thickness controlling member and the developer bearing member to charge the toner particles.

Comparative Example 8

The procedure for preparation and evaluation of the developing device in Comparative Example 7 was repeated except that the toner A was replaced with the toner B.

The evaluation results are shown in Table 1.

| | | | | Occurrence of toner hopping*3 (times) | | Formation of abnormal image*4 | |
|---|---|---|---|---|---|---|---|
| | Developing method | Material of outermost layer | Toner | Before running test | After running test | Before running test | After running test |
| Ex. 1 | NCODM* | Poly-Carbonate (having formula M-15) | A | 0 | 0 | No | No |
| Ex. 2 | " | Poly-Carbonate (having formula M-15) | B | 0 | 0 | No | No |
| Comp. Ex. 1 | " | Alkyd/melamine | A | 0 | 10 | No | Yes |
| Comp. Ex. 2 | " | Alkyd/melamine | B | 0 | 10 | No | Yes |
| Comp. Ex. 3 | " | Silicone | A | 0 | 10 | No | Yes |
| Comp. Ex. 4 | " | " | B | 0 | 10 | No | Yes |
| Comp. Ex. 5 | " | Polyester/melamine | A | 0 | 10 | No | Yes |
| Comp. Ex. 6 | " | Polyester/melamine | B | 0 | 10 | No | Yes |
| Comp. Ex. 7 | CODM** | Silicone | A | 10 | —*5 | Yes | Yes |
| Comp. Ex. 8 | " | " | B | 10 | —*5 | Yes | Yes |

NCODM*: Non-contact one-component developing method

CODM**: Contact one-component developing method

Occurrence of abnormal toner hopping*3: The number of an abnormal hopping phenomenon occurring before and after the 50,000-copy running test when 10 copies were produced.

Formation of abnormal images*4: Whether or not an abnormal image was formed before and after the 50,000-copy running test when 10 copies were produced.

—*5: The toner hardly hopped from the beginning of the running test. Therefore, evaluation could not be performed.

As shown in Table 1, no image problem was caused in Examples 1 and 2. However, in Comparative Examples 1-6, abnormal toner hopping phenomena (part of the toner particles did not hop or the toner particles weakly hopped) were observed, and thereby abnormal images were formed. In addition, in Comparative Examples 7 and 8, deterioration of the toner was accelerated due to mechanical stress, and thereby abnormal images were formed. As mentioned above, in Comparative Examples 7 and 8, the toner hardly hopped from the beginning of the running test.

As mentioned above, in conventional one-component developing methods, developer (toner) receives a strong force (friction) from a developer charging member (developer layer thickness controlling member). Therefore, low temperature fixable toner, which melts at a relatively low temperature, cannot be used for such conventional one-component developing methods. In contrast, in the flare developing method in the present invention, toner continuously hopping, resulting in charging of the toner. Namely, the force that the toner receives from a developer charging member can be reduced (i.e., to an extent such that the toner has enough charge for starting hopping). Therefore, the toner is prevented from being heated to a high temperature due to friction with the developer charging member, thereby solving the above-mentioned problems.

Specifically, the developing device of the present invention includes a developer charging member configured to charge a toner, and a developer bearing member configured to form an electric field so that the charged toner hops due to the electric field. More specifically, the toner is charged by very weak friction between the developer bearing member and the developer charging member, and then the charged toner hops due to the thus formed electric field. In the hopping process, toner particles repeatedly collide weakly with the surface of the developer bearing member, and thereby the toner can maintain the charge. Therefore, even when a low temperature fixable toner is used, the developing device of the present invention hardly causes the problem specific to conventional contact one-component developing devices such that the toner used deteriorates due to strong friction between a developer charging member and a developer bearing member.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2009-151360 and 2010-095689, filed on Jun. 25, 2009, and Apr. 19, 2010, respectively, the entire contents of which are herein incorporated by reference.

What is claimed is:

1. A developing device comprising:

a developer charging member configured to charge a toner serving as a one-component developer; and a developer hearing member configured to bear and feed the charged toner while forming an electric field so that the toner hops, wherein the developer hearing member includes:

an insulating substrate;

plural electrodes arranged on the insulating substrate in a developer feeding direction to form the electric field; and an outermost layer covering the plural electrodes, wherein the toner has a softening point of from 115° C. to 130° C.; and wherein the outermost layer includes a polymer including a chemical structural unit having the following formula (1):

(1)

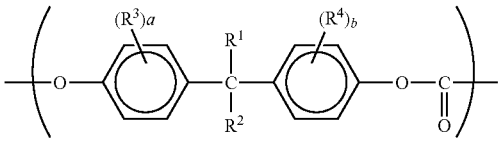

wherein each of $R^1$ and $R^2$ represents a hydrogen atom, an alkyl group, or an aryl group, wherein $R^1$ and $R^2$ optionally share bond connectivity to form a cyclic hydrocarbon group having 5 to 8 carbon atoms; each of $R^3$ and $R^4$ represents a hydrogen atom, a halogen atom, an alkyl group optionally having a substituent, or an aryl group optionally having a substituent; and a represents a number of the group $R^3$ connected with a benzene ring, b represents a number of the group $R^4$ connected with a benzene ring, and each of a and b is an integer of 1 or 2, wherein when a is 2, the two groups $R^3$ may be the same as or different from each other, and when b is 2, the two groups $R^4$ may be the same as or different from each other.

2. The developing device according to claim 1, wherein the outermost layer has a thickness of from 3 μm to 20 μm.

3. An image forming apparatus comprising:

an electrostatic latent image bearing member configured to bear an electrostatic latent image thereon; and the developing device according to claim 1 configured to develop the electrostatic latent image with a toner serving as a one component developer to form a toner image on the electrostatic latent image bearing member.

4. The image forming apparatus according to claim 3, wherein the outermost layer of the developer bearing member has a thickness of from 3 μm to 20 μm.

* * * * *